US009812252B2

(12) United States Patent
Gao et al.

(10) Patent No.: US 9,812,252 B2
(45) Date of Patent: Nov. 7, 2017

(54) ROLLED IRON CORE TRACTION TRANSFORMER

(71) Applicants: CHINA RAILWAY CORPORATION, Beijing (CN); SOUTHWEST JIAOTONG UNIVERSITY, Sichuan (CN); CHANG-ZHOU PACIFIC ELECTRIC POWER EQUIPMENT GROUP CO., LTD., Jiangsu (CN)

(72) Inventors: Shibin Gao, Sichuan (CN); Baoguo Wang, Beijing (CN); Zhiqiang Wu, Jiangsu (CN); Mindong Gao, Jiangsu (CN)

(73) Assignees: CHANGZHOU PACIFIC ELECTRIC POWER EQUIPMENT GROUP CO., LTD., Jiangsu (CN); SOUTHWEST JIAOTONG UNIVERSITY, Sichuan (CN); CHINA RAILWAY CORPORATION, Beijing (CN)

( * ) Notice: Subject to any disclaimer, the term of this patent is extended or adjusted under 35 U.S.C. 154(b) by 0 days.

(21) Appl. No.: 15/125,531

(22) PCT Filed: Apr. 20, 2015

(86) PCT No.: PCT/CN2015/000275
§ 371 (c)(1),
(2) Date: Sep. 12, 2016

(87) PCT Pub. No.: WO2015/180483
PCT Pub. Date: Dec. 3, 2015

(65) Prior Publication Data

US 2017/0076858 A1 Mar. 16, 2017

(30) Foreign Application Priority Data

May 26, 2014 (CN) ..... 2014 1 0223674

(51) Int. Cl.
*H01F 27/24* (2006.01)
*H01F 30/12* (2006.01)
(Continued)

(52) U.S. Cl.
CPC ..... *H01F 37/005* (2013.01); *H01F 17/02* (2013.01); *H01F 27/08* (2013.01); *H01F 27/29* (2013.01); *H01F 29/00* (2013.01)

(58) Field of Classification Search
USPC ..... 336/217, 5, 150, 138–147
See application file for complete search history.

(56) References Cited

FOREIGN PATENT DOCUMENTS

CN 101170011 A 4/2008
CN 201072699 Y 6/2008
(Continued)

OTHER PUBLICATIONS

English language abstract for CN 101170011 A (2008).
(Continued)

*Primary Examiner* — Ronald Hinson
(74) *Attorney, Agent, or Firm* — Caesar Rivise, PC

(57) ABSTRACT

A rolled iron core traction transformer, comprising an iron core (1); the iron core (1) is formed by splicing two symmetrical annealed iron-core closed single frames (1-1); each iron-core closed single frame (1-1) is formed by sequentially coiling continuous silicon steel sheets; the iron-core closed single frame (1-1) has two iron core column single bodies (1-1-1) having approximately semicircular cross sections; the iron core (1) has two iron core columns (1-2) thereon spliced by the iron core column single bodies (1-1-1) and having approximately circular cross sections; each iron core column (1-2) is sequentially provided with a low-voltage T winding (6), a low-voltage F winding (5) and a high-voltage winding (4) thereon from inside to outside; two sides of each high-voltage winding (4) are respectively
(Continued)

provided with a first tapping area and a second tapping area; the first tapping area is provided with low-voltage side high-voltage tapping outgoing lines (16); the second lapping area is provided with high-voltage side high-voltage tapping outgoing lines (18); two low-voltage side high-voltage tapping outgoing lines (16) are connected together via a no-load voltage regulation switch (9); and two high-voltage side high-voltage tapping outgoing lines (18) are connected together via another no-load voltage regulation switch (9). The transformer reduces no-load loss, has a small no-load current, low noise and strong anti-short circuit capability, reduces the electrodynamic force generated by a sudden short circuit, and improves the short circuit tolerance capability of the transformer.

9 Claims, 7 Drawing Sheets

(51) Int. Cl.

| | |
|---|---|
| ***H01F 21/12*** | (2006.01) |
| ***H01F 21/02*** | (2006.01) |
| ***H01F 37/00*** | (2006.01) |
| ***H01F 29/00*** | (2006.01) |
| ***H01F 17/02*** | (2006.01) |
| ***H01F 27/08*** | (2006.01) |
| ***H01F 27/29*** | (2006.01) |

(56) References Cited

FOREIGN PATENT DOCUMENTS

| | | |
|---|---|---|
| CN | 202067643 U | 12/2011 |
| CN | 202871487 U | 4/2013 |
| CN | 103996507 A | 8/2014 |
| CN | 203871160 U | 10/2014 |

OTHER PUBLICATIONS

English language abstract for CN 103996507 A (2014).
English language abstract for CN 201072699 Y (2008).
English language abstract for CN 202067643 U (2011).
English language abstract for CN 202871487 U (2013).
English language abstract for CN 203871160 U (2014).
International Search Report from PCT/CN2015/000275 dated Jul. 17, 2015.

ROLLED IRON CORE TRACTION TRANSFORMER

FIELD OF THE INVENTION

This invention relates to a rolled iron core traction transformer.

BACKGROUND OF THE INVENTION

Currently, the traction transformer is commonly used as a power equipment in the electrified railway field, which characteristic long time of no-load operation (the traction transformer is almost no-load in the trains gap period), high overload capacity, and more times of short-circuit. Conventional traction transformers are used the laminated iron core, which inner and outer coils are sequentially fitted over the iron core. The laminated iron core is made of the laminated silicon steel. The air gap, which has high value of magnetic reluctance, is formed in the butt joint of the silicon steel, so that no-load losses and no-load current is increased, and the noise is relatively larger. The process of cutting and stacking the silicon steel, which also makes the no-load losses increasing, will affect the arrangement of magnetic domains. A gap should be reserved when loop coils are looped, however the gap would decrease the resistance of short-circuit of the coil.

SUMMARY OF THE INVENTION

Technical problems will be solved by the invention to overcome the defects of the prior art, the invention provides a rolled iron core traction transformer, which can reduce no-load loss, has a smaller no-load current, lower noise and enhanced anti-short circuit, reduces the electrodynamic force generated by a sudden short circuit and improves the short circuit tolerance capability of the transformer.

In order to resolve the above mentioned technical problem, the invention provide with a rolled iron core traction transformer, which comprising an iron core, the iron core is formed by splicing two symmetrical annealed iron-core closed single frames, each iron-core closed single frame is formed by sequentially coiling continuous silicon steel sheets, the iron-core closed single frame has two iron-core column single bodies which cross sections are approximately semicircular, the iron core has two iron-core columns, which cross sections are approximately circular, thereon formed by splicing two iron-core column single bodies, each iron-core column is sequentially provided with a low voltage T winding, a low voltage F winding and a high voltage winding thereon from inside to outside; two sides of each high voltage winding are respectively provided with a first tapping area and a second tapping area, the first tapping area is provided with low voltage side high voltage tapping outgoing lines, the second tapping area is provided with high voltage side high voltage tapping outgoing lines, two low voltage side high voltage tapping outgoing lines are connected together with a no-load voltage regulation switch, and two high voltage side high voltage tapping outgoing lines are connected together with another no-load voltage regulation switch, the side of the high voltage winding is provided with high voltage winding outgoing lines, the low voltage T winding is provided with low voltage T winding outgoing lines on one opposite direction side of the high voltage winding outgoing lines, the low voltage F winding is provided with low voltage F winding outgoing lines on one opposite direction side of the high voltage winding outgoing lines.

Further, a cooling separation trough is provided between two iron-core closed single frames for lower the iron-core temperature and enhance over-excitation.

Further, the said two no-load voltage regulation switches are connected by a switch linkage, which achieving synchronization voltage regulation, to make the two no-load voltage regulation switch can be synchronized.

Further, on the both ends of the low voltage F winding and the high voltage winding are provided with electrostatic plates.

Further, the electrostatic plates are formed by welding two semi-circular brass rings.

Further, a T winding skeleton is provided inside of the low voltage T winding, a stay with caging device is provided between the T winding skeleton and the iron-core column, a F winding skeleton is provided inside of the low voltage F winding, and a stay with caging device is provided between the F winding skeleton and the T winding, a high voltage winding skeleton is provided inside of the high voltage winding, and a stay with caging device is provided between the high voltage winding skeleton and the low voltage F winding.

Further, the T winding skeleton and/or the F winding skeleton and/or the high voltage winding skeleton are/is made of hard paper tubes.

Further, a drive slot, which can be driven by a winder, is provided in the T winding skeleton.

Further, don't place stay between T winding skeleton and iron-core column first when wind windings. The position, which should be set the stay 19, is provided with transmission mechanism of the special no mold winder, and then forming the T winding skeleton. Then wind the low voltage T winding, the low voltage F winding and the high voltage winding in turn.

Furthermore, after winding all the said windings, the stay is arranged between T winding skeleton and iron-core column to tight the coils.

In the above-mentioned technical solution, the iron-core closed single frames is wound by continuous silicon steel, without air gap in the middle, so that the overheating, high noise, large excitation current which may be caused by local high magnetic flux density will be avoided. And after annealing process, the stress in the iron core that generated in the process is eliminated, thus no load loss is reduced too. The windings use double parallel column, the high voltage winding of each column provide with two tapping area. The unbalanced ampere turns due to tapping area between high and low winding is reduced by four tapping area, thereby the electric power generated when the sudden short-circuit is reduced, the withstanding short circuit capacity of the transformer is improved. All windings combine into one, with compact structure, enhance mechanical strength, high resistance capability to short-circuit.

DETAILED DESCRIPTION OF THE INVENTION

Figure 1:
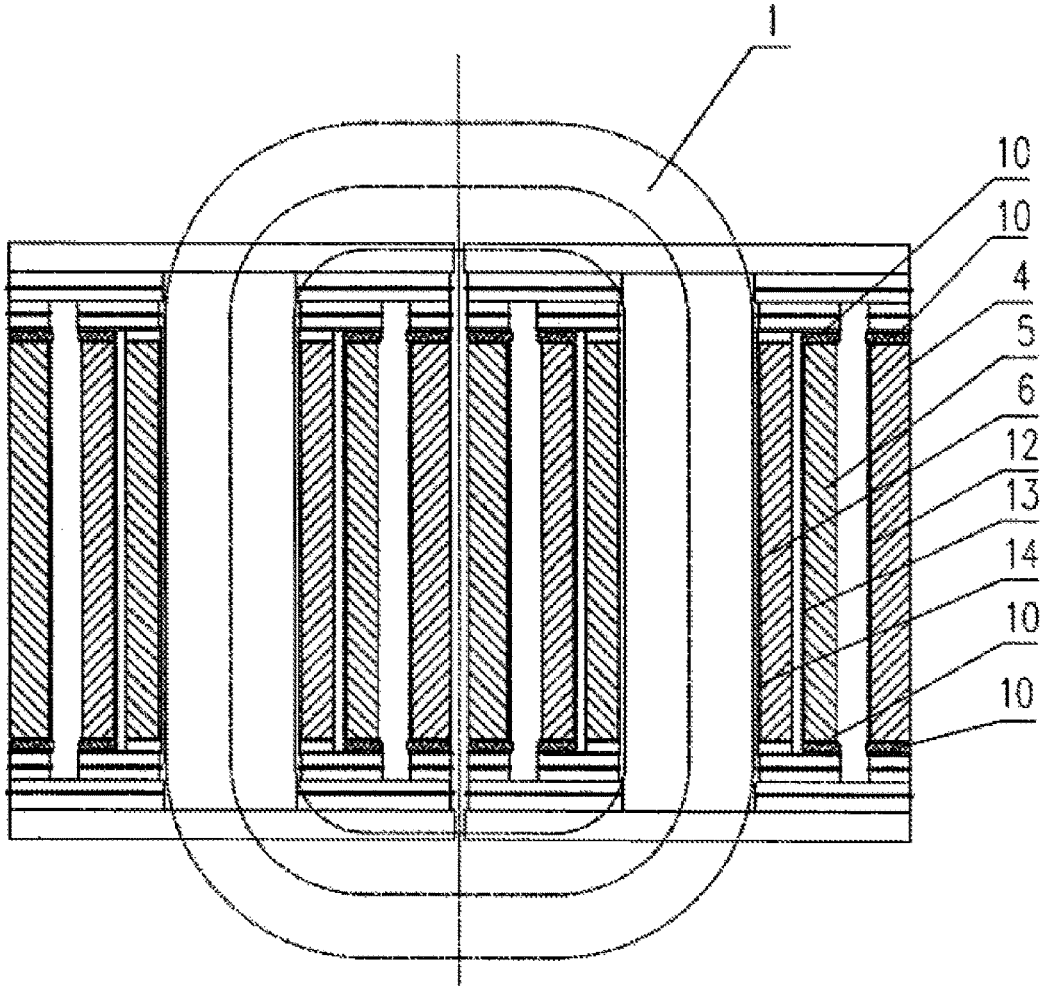
FIG. 1 is a section view of a rolled iron core traction transformer of the invention.

In order to understand the invention better and clearly, detail description with examples could be made of the invention.

As shown in FIG. 1-FIG. 4, a rolled iron core traction transformer, comprising an iron core 1, which spliced by two symmetrical annealed iron-core closed single frames 1-1, each iron-core closed single frame 1-1 is formed by sequentially coiling continuous silicon steel sheets. The iron-core closed single frame 1-1 has two iron-core column single bodies 1-1-1, which sections are approximately semicircular. The iron core 1 has two iron-core columns 1-2, which sections are approximately circular, thereon is formed by splicing the two iron-core column single bodies 1-1-1. Each iron-core column 1-2 is sequentially provided with a low voltage T winding 6, a low voltage F winding 5 and a high voltage winding 4 thereon from inside to outside; two sides of each high voltage winding 4 are respectively provided with a first tapping area and a second tapping area, the first tapping area is provided with low voltage side high voltage tapping outgoing lines 16, the second tapping area is provided with high voltage side high voltage tapping outgoing lines 18. two low voltage side high voltage tapping outgoing lines 16 are connected together with a no-load voltage regulation switch 9, and two high voltage side high voltage tapping outgoing lines 18 are connected together with another no-load voltage regulation switch 9. The side of the high voltage winding 4 is provided with high voltage winding outgoing lines 17, low voltage T winding outgoing lines 15-1 of the low voltage T winding 6 is provided on one side of opposite direction of the high voltage winding outgoing lines 17 on the low voltage T winding 6. Low voltage F winding outgoing lines 15-2 of the low voltage F winding 5 is provided on one side of opposite of the high voltage winding outgoing lines 17 on the low voltage F winding 5. The iron-core closed single frames 1-1 is wound by continuous silicon steel, without air gap in the middle, in order to avoid overheating, noise, large excitation current caused by local high magnetic flux density, and eliminating the stress of the iron core after annealing process, further reducing no load loss. The winding uses double column parallel, the high voltage winding of each column sets two tap area. four tap area reduce unbalanced ampere turns of due to tap area production between high and low winding, thereby the electric power generated when the sudden short-circuit is reduced, the withstanding short circuit capacity of the transformer is improved.

Figure 5:
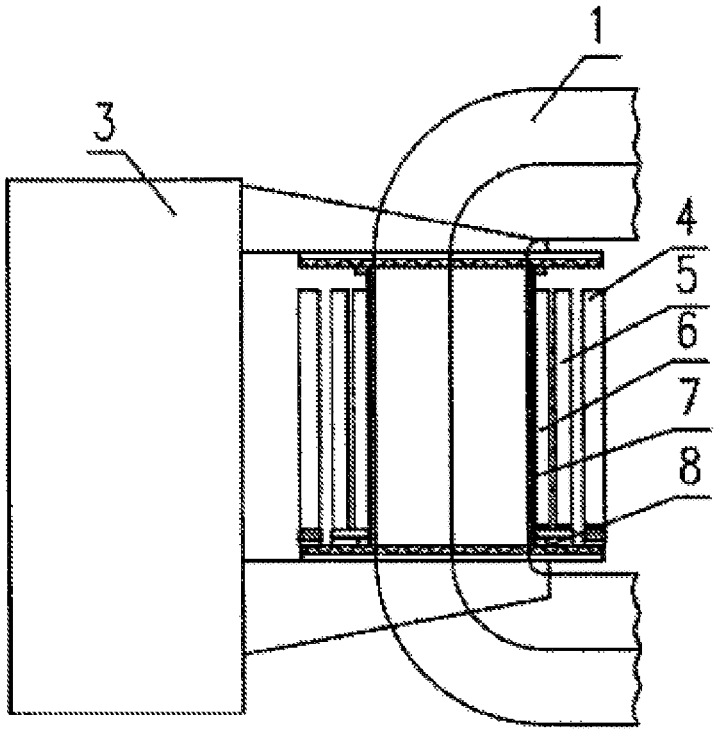
FIG. 5 is a rolling schematic diagram of the winding of the invention.
Figure 6:
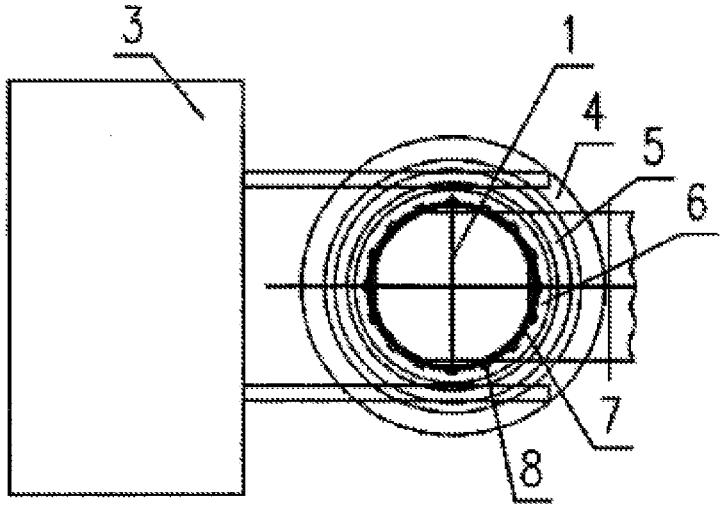
FIG. 6 is a top view of the FIG. 5.

As shown in FIG. 5 and FIG. 6, since the iron core 1 is a closed rolled iron core, so all of the low voltage T winding 6, all of the low voltage F winding 5 and all of the high voltage winding 4 must be wound on the iron-core column 1-2 of the iron core 1. The low voltage T winding 6, the low voltage F winding 5 and the high voltage winding 4 are all around the iron-core column 1-2 into one in a special vertical mode free winder 3, which drives the forming skeleton 7 of coils to rotate. Wire winds around and rolls over the forming skeleton 7 to form a coil. The forming skeleton 7 is provided with a drive slot, into which the drive pin 8 of the vertical mode free winder 3 extends, to drive the forming skeleton 7 to rotate around the iron-core column 12, thus to wind the low voltage T winding 6, the low voltage F winding 5 and the high voltage winding 4. The FIG. 5 and FIG. 6 show a method of mode free vertical winding, which is the only way to achieve wound pancake coil on a large rolled iron-core.

Figure 4:
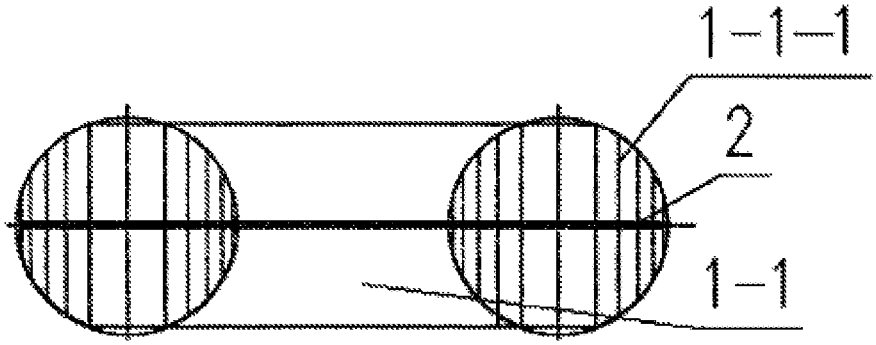
FIG. 4 is cross-sectional view of the iron core of the invention.

As shown in FIG. 4, a separation trough 2 for cooling is provided between two iron-core closed single frames 1-1, thus to lower the iron core temperature, enhance over-excitation and improve utilization of the silicon steel. One function of the separation trough 2 is heat radiation, and another is to divide the iron core into two approximately semicircular, to make the silicon steel easy to be cut completely even if the iron core diameter is larger.

Figure 2:
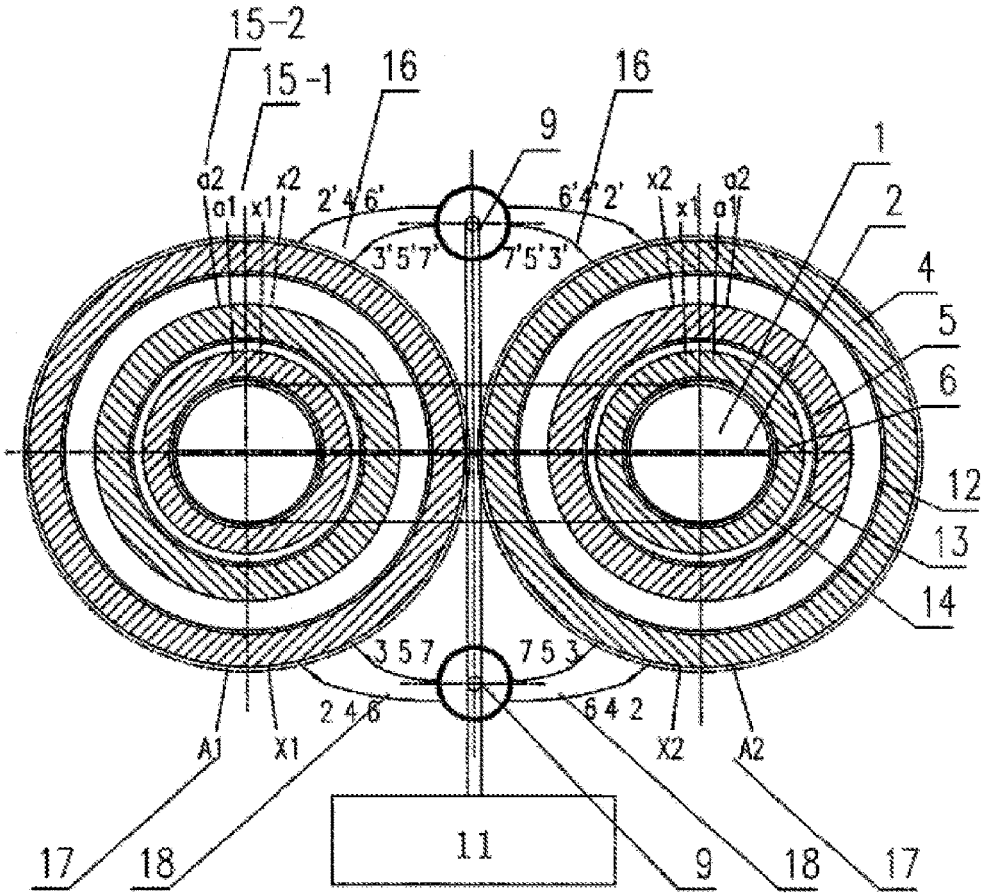
FIG. 2 is a top view of the FIG. 1.
Figure 3:
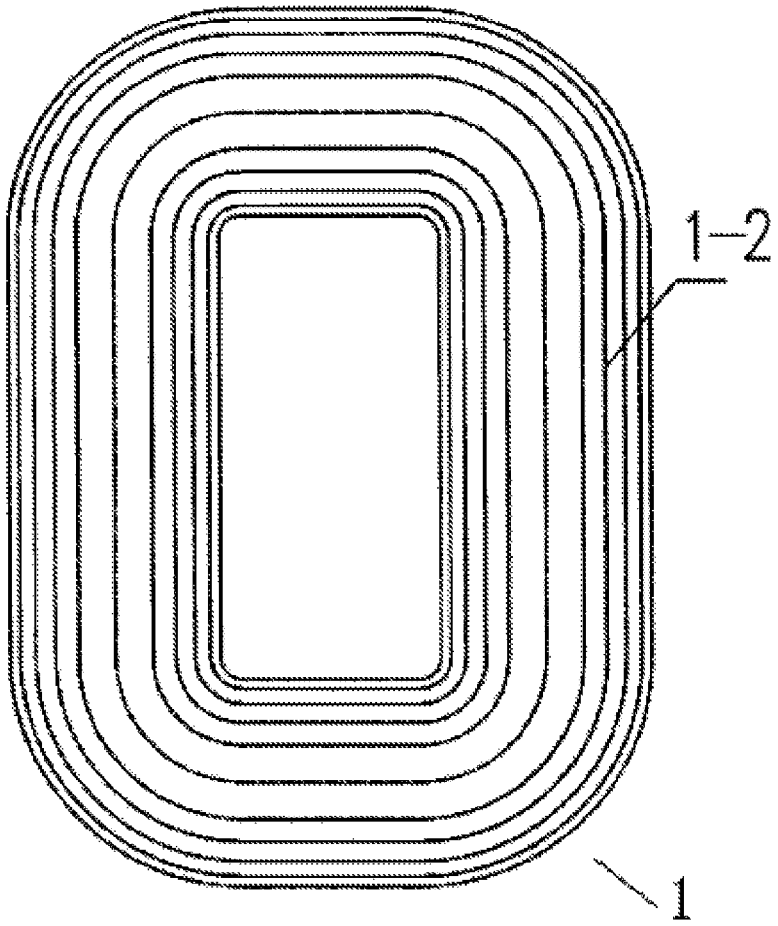
FIG. 3 is a schematic diagram of the iron core of the invention.
Figure 7:
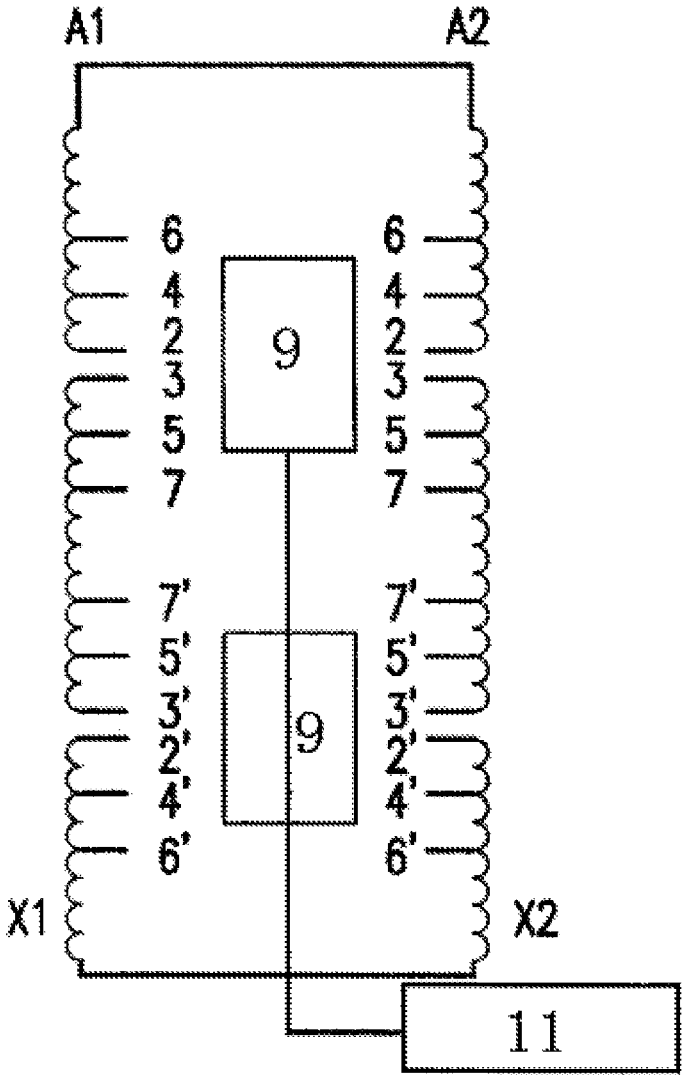
FIG. 7 is a wiring schematic diagram of the high voltage winding of the invention.

As shown in FIG. 2 and FIG. 7, two no-load voltage regulation switches 9 are connected by a switch linkage 11 for synchronization voltage regulation.

Figure 8:
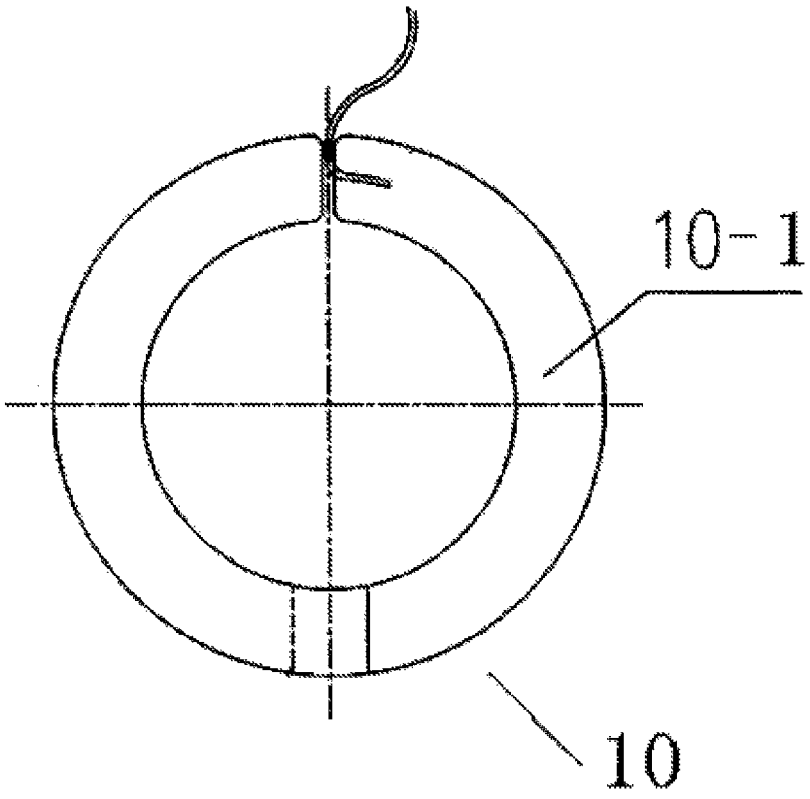
FIG. 8 is an installation schematic diagram of the electrostatic plate of the invention.

As shown in FIG. 1, electrostatic plates 10 are provided on the both ends of the low voltage F winding 5 and the high voltage winding 4. The electrostatic plate 10 is formed by welding two semi-circular brass rings 10-1. The electrostatic plate 10 is placed in pairs, such as the electrostatic plates 10 are provided on the both ends of the low voltage F winding 5, which adjacent to high voltage winding 4. As shown in FIG. 8. to be installed on the closed iron core 1, the electrostatic plate 10 is formed by joining two semi-circular together, specifically, welding the surrounding rounded semicircle copper ring 10-1, which spliced on the iron core 1, and the following smooth polishing. The electrostatic plate 10 of the high voltage winding 4 can be produced by the above method.

As shown in FIG. 2 and FIG. 8, the T winding skeleton 14 is provided inside the low voltage T winding 6, the stay 19 with caging device is provided between the T winding skeleton 14 and the iron-core column 1-2, the F winding skeleton 13 is provided inside of the low voltage F winding 5, also the stay 19 with caging device is provided between the F winding skeleton 13 and the T winding skeleton 6, a high voltage winding skeleton 12 is provided inside the high voltage winding 4, also the stay 19 with caging device is provided between the high voltage winding skeleton 12 and the low voltage F winding 5. The T winding skeleton 14 and/or the F winding skeleton 13 and/or the high voltage winding skeleton 12 are/is made of hard paper tubes. A drive slot, which can be driven by winders, is provided with the T winding skeleton 14. For all the stays between the windings having caging device, stay 19 will not be placed between T winding skeleton 14 and iron-core column 1-2 at first when wind windings, to prevent the stays shift while wind windings. The position, which should be set the stay 19, is provided with transmission mechanism of the special no mold winder, and then the T winding skeleton 14 is formed on it. After that, the low voltage T winding 6, the low voltage winding F 5 and high voltage winding 4 are wound in turn. After all windings are wound, put the stay 19 between T winding skeleton 14 and iron-core column 1-2 to tight the coils.

Figure 9:
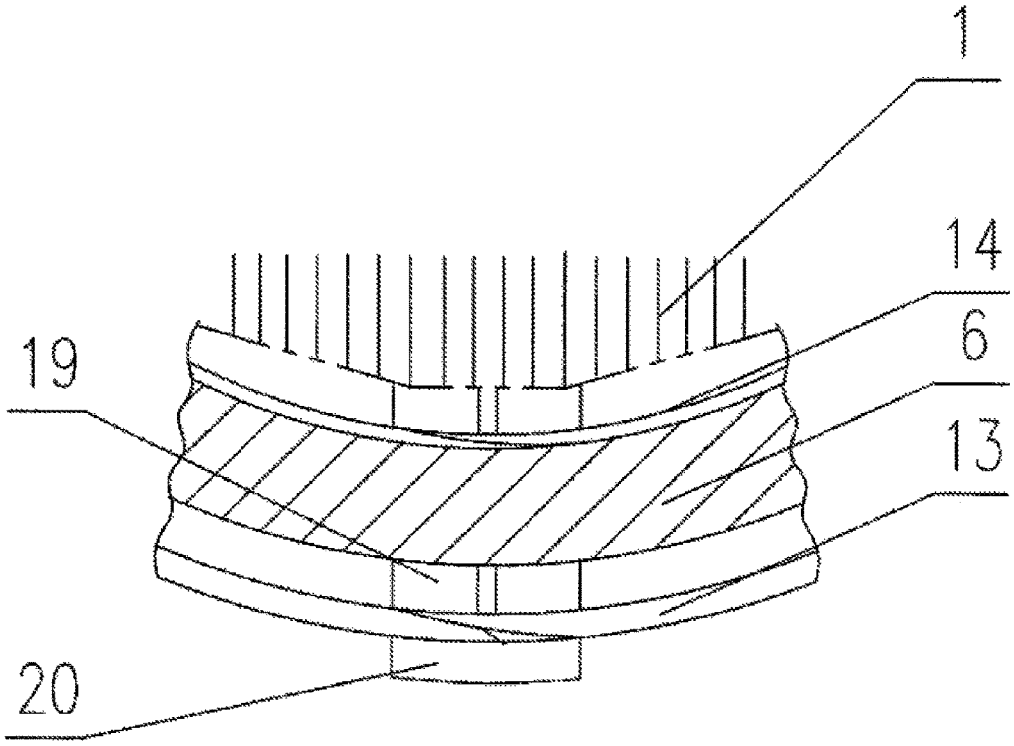
FIG. 9 is an installation diagram of the skeleton of the invention.

All coils using hard paper tube as a skeleton, the hard paper tube is spliced directly, as shown in FIG. 9, the stay 19 adjacent to the lap of the hard paper tube of the low voltage F winding 5 is designed as the shape of the inner mold, after gluing in lapped ramp of the hard paper tube of the low pressure F winding 5 an outer mold 20 is used to press for forming, then the low voltage F winding 5 can be wound in the hard paper tube of the low voltage F winding 5. The same process can be used for the hard paper tube of the low voltage T winding 6 and the hard paper tube of the high voltage winding 4.

Specific embodiments described above, are further explanation for the technical problem solved by the invention, technical solutions, and beneficial effects. It should be understood that the above description is only the specific embodiments of the present invention, and not limit the invention, within the spirit and principles of the present invention, made any modifications, equivalent replacements and improvements, they should be included in the scope of the invention as defined by claims.

The invention claimed is:

1. A rolled iron core traction transformer, comprising an iron core comprising two annealed iron-core closed single frames symmetrically spliced together, each iron-core closed single frame being formed of sequentially coiled continuous silicon steel sheets and having two iron-core column single bodies, the iron-core column single bodies having approximately semicircular sections, two iron-core columns which have approximately circular sections and having spliced thereon two iron-core column single bodies, each iron-core column being sequentially provided with a low voltage T winding, a low voltage F winding and a high voltage winding thereon from inside to outside; two sides of each high voltage winding are respectively provided with a first tapping area and a second tapping area, the first tapping area is provided with low voltage side high voltage tapping outgoing lines, the second tapping area is provided with high voltage side high voltage tapping outgoing lines, two low voltage side high voltage tapping outgoing lines are connected together with a no-load voltage regulation switch, and two high voltage side high voltage tapping outgoing lines are connected together with another no-load voltage regulation switch, the side of the high voltage winding is provided with high voltage winding outgoing lines, low voltage T winding outgoing lines of the low voltage T winding is provided on one side of the opposite direction of the high voltage winding outgoing lines on the low voltage T winding, low voltage F winding outgoing lines of the low voltage F winding is provided on one side of the opposite direction of the high voltage winding outgoing lines on the low voltage F winding.

2. The rolled iron core traction transformer according to claim 1, wherein a separation trough for cooling is provided between two iron-core closed single frames.

3. The rolled iron core traction transformer according to claim 1, wherein two no-load voltage regulation switches are connected with a switch linkage for synchronous voltage regulation.

4. The rolled iron core traction transformer according to claim 1, wherein electrostatic plates are provided on the both ends of the low voltage F winding and the high voltage winding.

5. The rolled iron core traction transformer according to claim 4, wherein the electrostatic plate is formed by winding two semi-circular brass rings together.

6. The rolled iron core traction transformer according to claim 1, wherein a T winding skeleton is provided on the inside of the low voltage T winding, stays with caging device are provided between the T winding skeleton and the iron-core column, F winding skeleton is provided on the inside of the low voltage F winding, also the stay with caging device is provided between the F winding skeleton and the low voltage T winding, high voltage winding skeletons are provided on the inside of the high voltage winding, also the stay with caging device is provided between the high voltage winding skeletons and the low voltage F windings.

7. The rolled iron core traction transformer according to claim 6, wherein at least one of the T winding skeleton, the F winding skeleton and the high voltage winding skeleton is made of hard paper tube.

8. The rolled iron core traction transformer according to claim 6, wherein the T winding skeleton is provided with a drive slot, which can be driven by a winder.

9. The rolled iron core traction transformer according to claim 7, wherein the T winding skeleton is provided with a drive slot, which can be driven by a winder.

* * * * *